US006202871B1

(12) United States Patent
Kelly

(10) Patent No.: US 6,202,871 B1
(45) Date of Patent: Mar. 20, 2001

(54) VENTED BEVERAGE CLOSURE

(75) Inventor: Ronald L. Kelly, Chester, VA (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/384,825

(22) Filed: Aug. 27, 1999

(51) Int. Cl.[7] ..... B65D 51/16
(52) U.S. Cl. ..... 215/307; 215/350
(58) Field of Search ..... 215/260, 270, 215/271, 307, 313, 341, 349, 350; 220/203.05, 203.06

(56) References Cited

U.S. PATENT DOCUMENTS

| | | | | |
|---|---|---|---|---|
| 1,694,851 | * | 12/1928 | Glass | 215/260 |
| 2,980,276 | * | 4/1961 | Robineau | 215/260 |
| 4,382,521 | | 5/1983 | Ostrowsky . | |
| 4,392,579 | * | 7/1983 | Uhlig et al. | 215/253 |
| 4,427,126 | | 1/1984 | Ostrowsky . | |
| 4,799,598 | * | 1/1989 | McFadyen | 215/260 |
| 4,813,561 | | 3/1989 | Ochs . | |
| 5,021,515 | | 6/1991 | Cochran et al. . | |
| 5,062,538 | * | 11/1991 | Ochs | 215/260 |
| 5,639,815 | | 6/1997 | Cochran et al. . | |
| 5,833,088 | * | 11/1998 | Kladders et al. | 215/248 |
| 5,979,683 | * | 11/1999 | Kobayashi et al. | 215/352 |
| B1 4,427,126 | | 12/1984 | Ostrowsky . | |

FOREIGN PATENT DOCUMENTS

WO 99/26855 6/1999 (WO) .

* cited by examiner

*Primary Examiner*—Stephen K. Cronin
(74) *Attorney, Agent, or Firm*—Woodcock Washburn Kurtz Mackiewicz & Norris LLP

(57) ABSTRACT

A container assembly includes a container and a closure that has plural vents formed proximate its top member, preferably at a transition between the top member and the skirt. The closure includes a feature that spaces apart an edge of a liner, outside of which the vents are formed, and provides tamper protection. The closure and the container neck form a top and corner seal therebetween while the closure is in a fully closed position, and provide a gap when the closure is in a vented position. P gases within the container escape through the gap and the vents when the closure is unthreaded from the fully closed to the vented position. The vents may be configured such that the vent outlet is oriented substantially vertically to vertically direct the outbound gases to prevent closure blow-off and to avoid impinging against a user's hand.

15 Claims, 4 Drawing Sheets

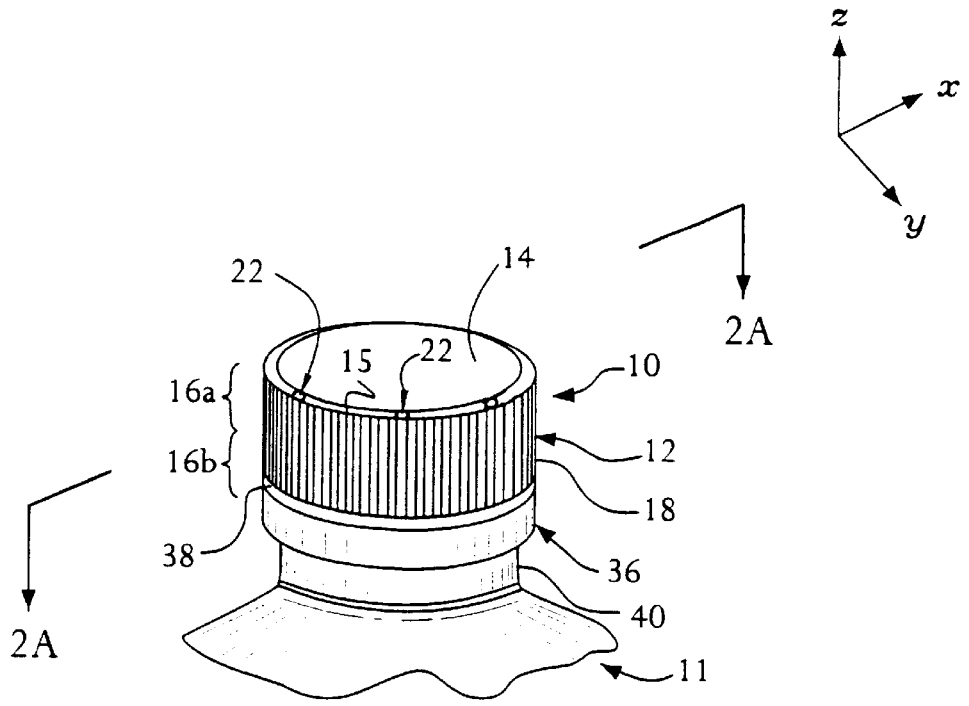
FIG. 1
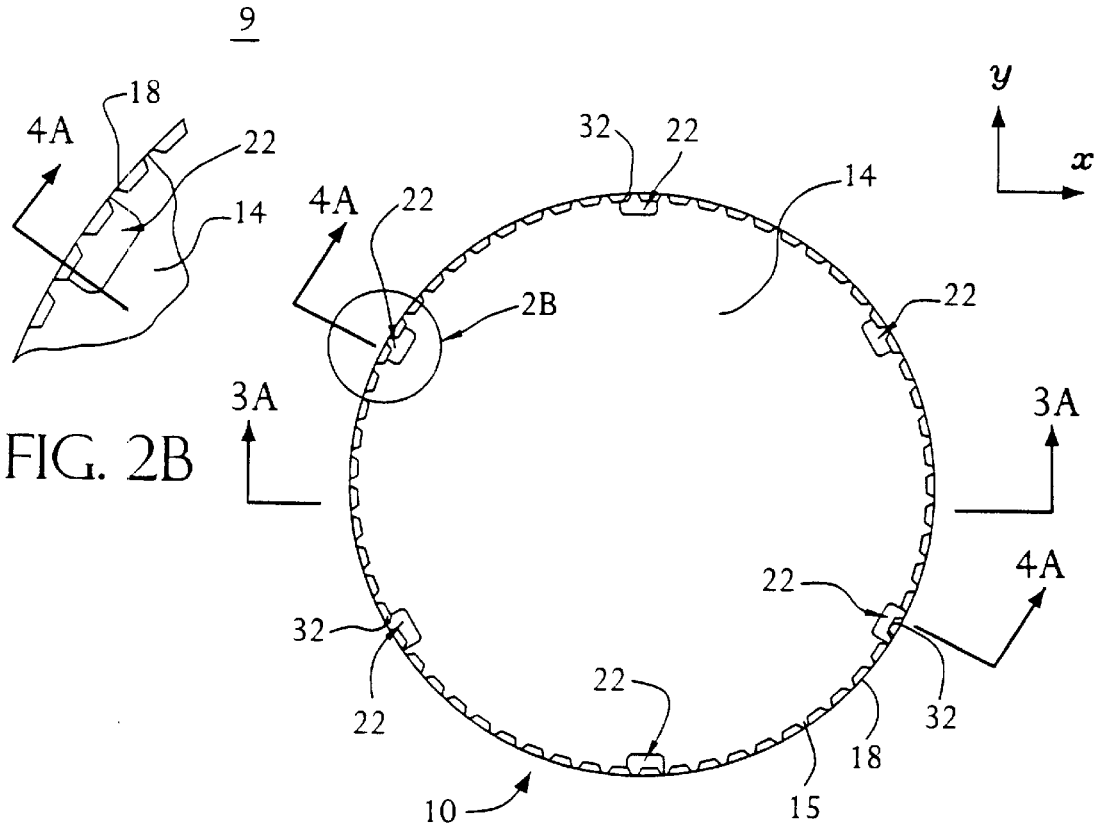
FIG. 2B
FIG. 2A

VENTED BEVERAGE CLOSURE

BACKGROUND

This invention relates to containers, more particularly to containers for beverages and other pressurized products, and even more particularly to vented containers for beverages and other pressurized products.

Containers with removable closures are often employed for beverages and similar food items. Often containers hold products that are carbonated or otherwise pressurized with a gas For example, carbonated soda or sparkling water includes dissolved carbon dioxide and is bottle at greater than atmospheric pressure. The total pressure within the container is subject to sharply increasing pressure upon an increase in product temperature and upon agitation.

A typical container assembly may include a container, a closure, and (optionally) a liner. The container often has a threaded neck and a top opening. The closure often is substantially cylindrical and includes internal threads that cooperate with the threads on the neck. The liner is disposed inside of the closure above the threads. An interior of the closure and a top portion of the neck urge against the liner to seal the container opening while the closure is in a fully thread position. The container is often formed of a glass or blow-molded plastic, the closure of an injected molded or a compression molded thermoplastic, and the liner of EVA.

Conventional threaded closures employed with carbonated beverages often ineffectively release the internal pressure of the container during opening. For example, upon an initial twist of a conventional closure, the closure and liner move relative to the container body in a screw-like manner. In response to the twisting, the sealing surfaces separate such that the high pressure gases pass through the neck and through the spaced-apart sealing surfaces. The gasses turn direction from substantially upward to substantially downward proximate the inner face of the closure to pass through the threads.

However, because the threads typically present a high pressure drop, the gas pressure only slowly dissipates. Because the closure is partially unscrewed from the container before the pressure dissipates, the pressure urging upward against the closure top and outward against the closure skirt sidewalls may force the closure off the container neck. This phenomenon, which is termed "tail end blow off," may propel the closure from the container and cause injury to persons in the path of the closure projectile. Tail end blow off may occur under high pressure conditions that may be caused by agitation or high temperature of the product common in the usual course of storage and use of the container.

U.S. Pat. No. 4,427,126, entitled "Vented Closure," which is incorporated herein in its entirety, includes vertical grooves formed on the inside surface of the closure that interrupt the threads to promote release of the gas downward through the threads. However, the disclosed closure has several drawbacks. The downward grooves may provide insufficient venting, as evident from its teaching of an extended closure that requires a user to make two turning motions to disengage the closure from the container. The extended closure increases the cost of the closure and inconveniences the user. Further, if a user grips the closure and container neck with his palm, the gases and entrained liquid droplets flowing through the grooves may impinge upon and wet the user's hand.

If is generally difficult simultaneously to provide venting and to maintain tamper resistant measures, including providing indication of an attempt to tamper with the container and its contents.

It is a goal of the present invention to provide a container closure that effectively releases the internal pressure of the container during opening while maintaining tamper-resistance.

SUMMARY

A closure, which is part of a container assembly for holding pressurized beverages, is provided. The container assembly comprises a container having a neck including a first thread formed thereon. The closure has a top member and a circular skirt downwardly depending therefrom. The skirt has a second thread formed thereon that is in cooperation with the first thread to enable the closure to move between a fully closed position and a vented position relative to the container. The closure and the container neck form a seal therebetween while the closure is in the fully closed position. The top member has vents or vent holes formed therein that vents pressurized gases from the container's internal chamber during the process of opening the container assembly from the fully closed position to the vented position, and while the container assembly is in the vented position. The vent holes may be formed proximate an outer edge of the top member proximate a junction area between the top member and the skirt, and preferably at the outer perimeter of the top member and/or the uppermost portion of the skirt.

The container assembly may further comprise a liner disposed on the interior surface of the top member configured such that the vent holes are formed outside a perimeter of the liner. The seal between the container and the closure preferably is formed by an underside or interior surface of the top member and an upper rim of the container neck urging against opposing sides of the liner, which is termed a top seal.

The closure includes a corner seal including a ridge peak that defines a ridge surface and an overhanging surface. The ridge surface and overhanging surface define a ridge portion of the closure. The ridge portion projects below the rim such that the lower boundary of the ridge portion is disposed lower than the uppermost rim surface to prevent exposing an edge or end portion of the liner through the vent holes. In embodiments that lack the liner, the ridge portion similarly projects below the rim to prevent straight line access to an interface area between the closure and the rim via the vent holes. The lowermost portion of the vent holes is high enough on the sidewall to prevent angled access to the liner edge. Preventing straight line access to the side or edge of the liner inhibits piercing of the liner and provides evidence of an attempt to penetrate the seal, thereby inhibiting tampering.

The vent holes may be bounded by an outer sidewall formed on the container skirt to form a substantially vertical vent outlet to direct the vent approximately parallel to the longitudinal axis (that is, z-axis) of the container assembly. Alternatively, the closure may lack the sidewall at the outer portion of the vent hole to increase effective cross sectional area of the flowpath.

BRIEF DESCRIPTION OF THE FIGURES

FIG. 1 is a perspective view of a container assembly according to an embodiment of the present invention;

FIG. 2A is an enlarged top view of the container assembly of FIG. 1 as indicated by the lines 2A—2A;

FIG. 2B is an enlarged view of a portion of the FIG. 2A;

DESCRIPTION OF A PREFERRED EMBODIMENT

Figure 4A:
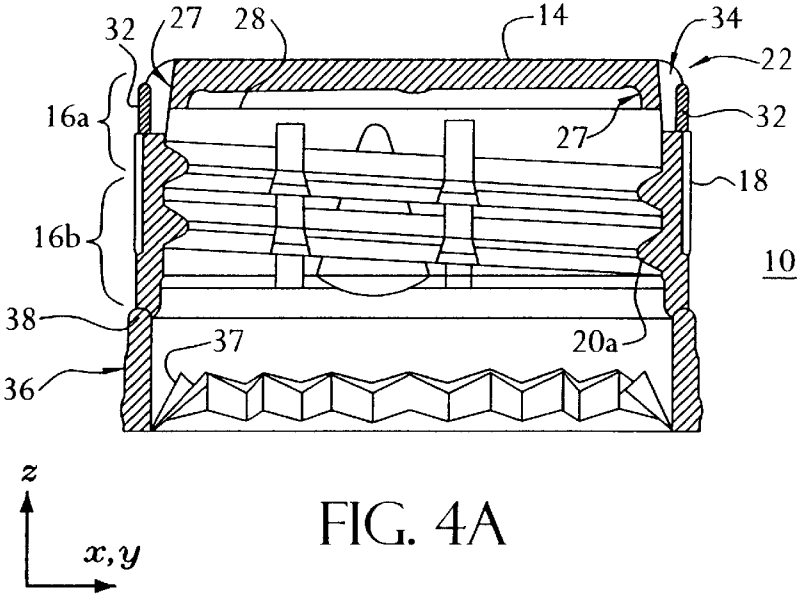
FIG. 4A is a cross sectional view taken along lines 4A—4A in FIG. 2A showing an embodiment of the present invention.

Referring to FIG. 1, a container assembly 9 according to the present invention includes a closure 10 and a container 11. The container assembly preferably contains a carbonated or pressurized liquid (not shown), such as a carbonated beverage.

Referring to FIGS. 1 through 4A and 5A through 6B, closure 10 includes a skirt 12, a top member 14, a liner 24 (shown only in FIGS. 5A through 6B), and a tamper evident band 36. Skirt 12 is preferably generally annular or cylindrical and depends downwardly from top member 14, which preferably is substantially flat or slightly crowned. Skirt 12 has an upper portion 16*a*, to which the top member is coupled, and a lower portion 16*b*, to which a tamper evident band is attached. As best shown in FIGS. 3A and 3B, an outer perimeter of top member 14 is preferably integrally joined to upper end portion 16*a* of skirt 12, and may be formed of a compression injected thermoplastic. Alternatively, skirt 12 and top member 14 may be non-integrally formed, such as, for example, as described in U.S. Pat. No. 4,813,561, entitled, "Composite Retortable Closure," which is incorporated herein in its entirety.

Figure 3A:
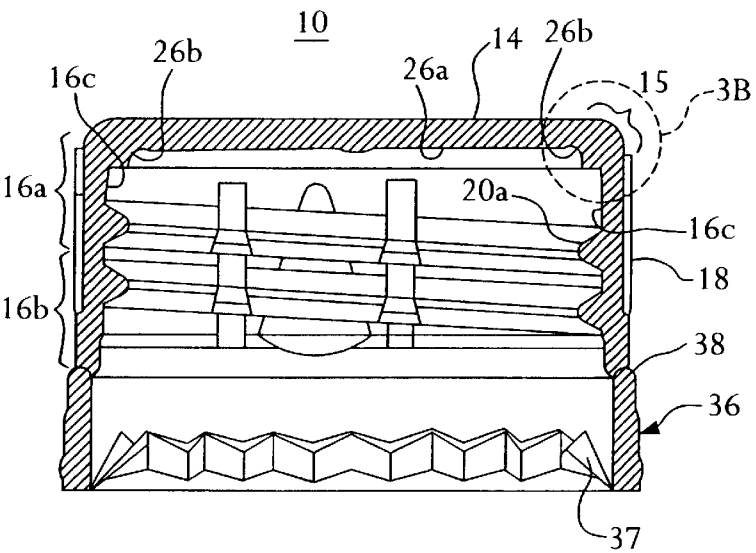
FIG. 3A is a cross sectional view of a portion of the container assembly taken along lines 3A—3A in FIG. 2A.
Figure 3B:
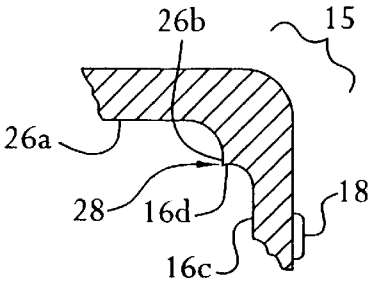
FIG. 3B is an enlarged view of a portion of the closure shown in FIG. 3A.

The portion of closure 10 at which skirt 12 and top member 14 coincide (that is, where skirt 12 and top member 14 meet and which may be considered as both a portion of skirt 12 and top member 14) is designed as transition 15, as best shown in FIGS. 3A and 3B. Preferably, skirt 12 and top member 14 are configured such that they are substantially perpendicular at the point at which they are joined, as shown in the Figures. An outer surface of skirt 12 may include plural ribs 18 to enhance gripping by a user. A thread 20*a* (or plural threads) preferably is disposed on an inside surface of skirt 12.

Figure 6A:
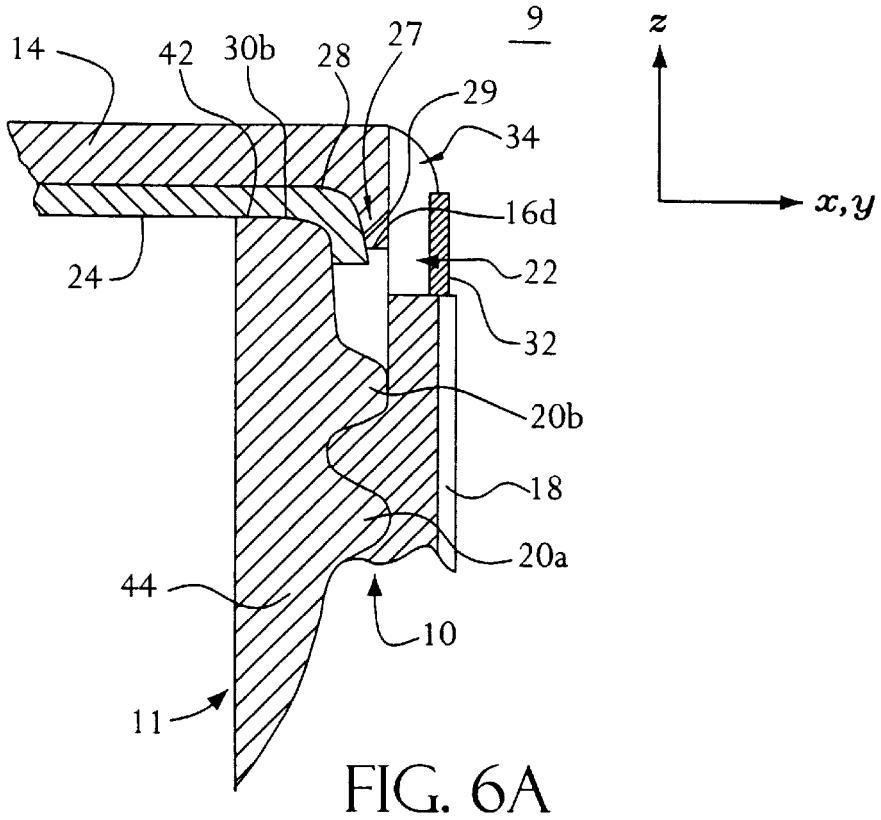
FIG. 6A is an enlarged view of a corner portion of the container assembly of FIG. 5A.

Referring to FIGS. 3A and 3B, the substantially planar or slightly crowned inside surface 26*a* of top member 14 preferably smoothly yields to a circular or cylindrical down-turned ridge surface 26*b*. A circular or cylindrical inner surface 16*c* of skirt 12, which generally are disposed within upper portion 16*a* and above or interposed with threads 20*a* (described below), has a larger diameter than ridge surface 26*b*, and smoothly yields to a overhanging edge 16*d* such that a ridge peak 28 is formed between ridge surface 26*b* and overhanging edge 16*d*. Ridge peak 28 and ridge surface 26*b* are spaced apart from and concentrically inside of inner surface 16*c* of skirt 12. Ridge surface 26*b*, overhanging edge 16*d* define the inner and lower boundaries of a ridge portion 29, which is shown in FIG. 6A. An outer boundary of the ridge portion 29 is formed by an inboard wall of vent 22 (as described below) in the portion of closure 10 that includes the vents 22 (as described below), and by the outer perimeter of the skirt 12 in the portion of the closure that lacks the vents 22. Ridge peak 28, ridge surface 26*b*, overhanging edge 16*d*, and ridge portion 29 form a baffle 27.

As shown in FIGS. 5A, 5B, 6A, and 6B, liner 24 is a thin, disk-like member that is adhered to an inside of top member 14, preferably by using an adhesive (not shown) therebetween or by other conventional means. Liner 24 may be formed of a flexible or pliable conventional plastic, such as EVA, such that liner 24 bends to adheres to the inside surface 26*a* of top member 14 and conforms to the ridge surface 26*b*. Specifically, a perimeter of liner 24 may have a shape that conforms to the shape of ridge surface 26*b* such that liner 24 has edge portions 30*a* that are down-turned. Substantially concentrical inside of or within (that is, having a smaller diameter than) edge portions 30*a*, a liner compression portion 30*b* is formed, as explained below.

Referring to FIGS. 1, 2A, 2B, 4A, and 4B to illustrate an aspect of the present invention, plural vents 22 are formed through the body of closure 10 (that is, from a closure inside surface to a closure outside surface). Preferably, vents 22 are formed at transition 15 such that a portion of each of the top member 14 and the skirt 12 are removed to form vents 22. Thus, vents 22 are preferably formed at a perimeter of closure 10 and/or at the uppermost portion of skirt 12.

The Figures show six rectangular vents 22 circumferentially, equidistantly spaced around the perimeter. The present invention encompasses any number and configuration of the vents, including, for example, circular vents and vents that are formed entirely within top member 14 and that are formed entirely within skirt 12. FIG. 2A, FIG. 2B, FIG. 3A, which is taken through a section of closure 10 lacking or spaced apart from vents 22, and FIG. 4A, which is taken through a section of closure 10 having vents 22, illustrate that the outer perimeter of top member 14 includes both solid transition portions 15 and vents 22.

Referring to FIG. 4A to illustrate an embodiment of vents 22 according to an aspect of the present invention, upper portion 16*a* of skirt 12 includes an upwardly extending sidewall 32 that encloses at least a portion of each of the vents 22. Sidewall 32 may have a thin width such that it does not carry a significant structural load (for example, during twisting). Thus, each of the vents 22 is at least partly formed by an interior surface of sidewall 32, a outer portion ridge portion 29 (opposite sidewall 32), and opposing ends of transitions 15. Sidewalls 32 extend upward from a base of skirt 12 to provide skirt 12 with a substantially even circular or cylindrical outer perimeter even throughout much of the portion from which vents 22 are formed. Thus, only an uppermost portion of each of the vents is visible from the outside of the closure.

Sidewalls 32 are configured such that an outlet 34 of each of the vents 22 is oriented substantially vertically. Thus, the vent outlet 34 is formed on an exterior of closure 10, and the vent inlet, which is formed between closure inner surface 16*c* and overhanging edge 16*d*, is formed on an interior of closure 10. The interior surface of sidewall 32 (and corresponding portions of the ridge portion 29 opposite sidewall 32 and opposing ends of transitions 15) may form a rectangular passage having an axis that is substantially vertical (that is, parallel to the z-axis).

Figure 4B:
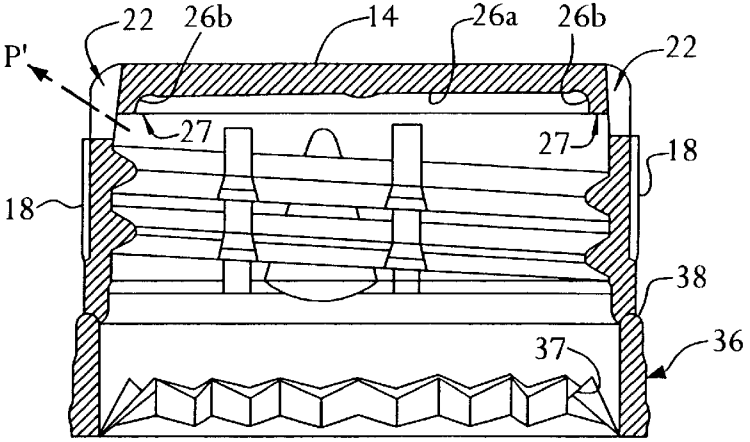
FIG. 4B is a cross sectional view similar to that shown in FIG. 4A showing another embodiment of the present invention.

Referring to FIG. 4B to illustrate another embodiment of an aspect of the present invention, vents 22 may be formed without sidewall 32 such that the outlet is non-vertical (that is, the vent forms a passage having a directional component in the x-y plane at its outlet). The vents as shown in FIG. 4B provide a larger cross sectional area than those of FIG. 4A, which may provide increased flow that more quickly dissipate high pressure within container 11. Alternatively, vents 22 arranged as shown in FIG. 4A direct outbound flow substantially directly upward, which enables pressure release from the inside of container 11 without the pressurized gases impinging on a user's hand if the user grips closure 10 only by ribs 18 without overhanging top member 14.

Figure 5B:
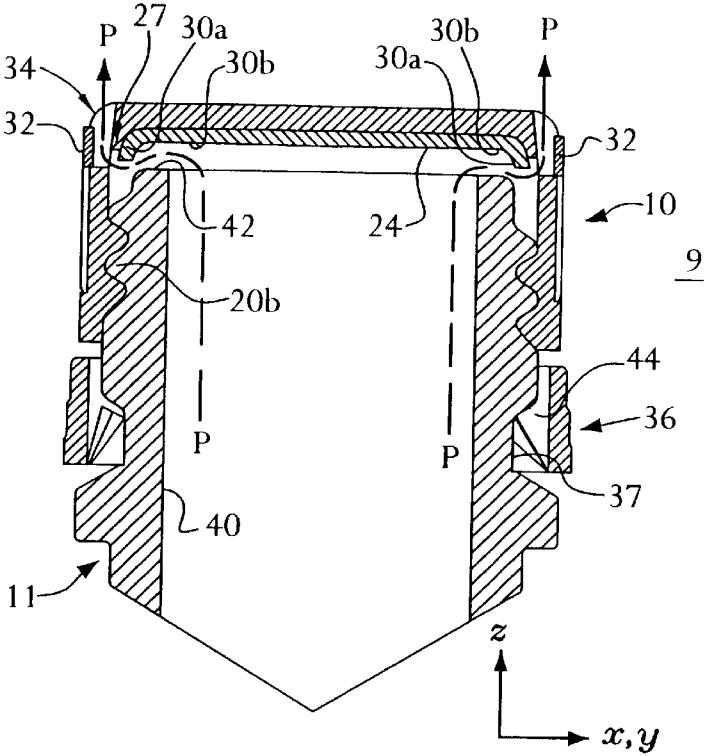
FIG. 5B is an enlarged cross sectional view of the container assembly of FIG. 1 showing the closure in a vented position.
Figure 5A:
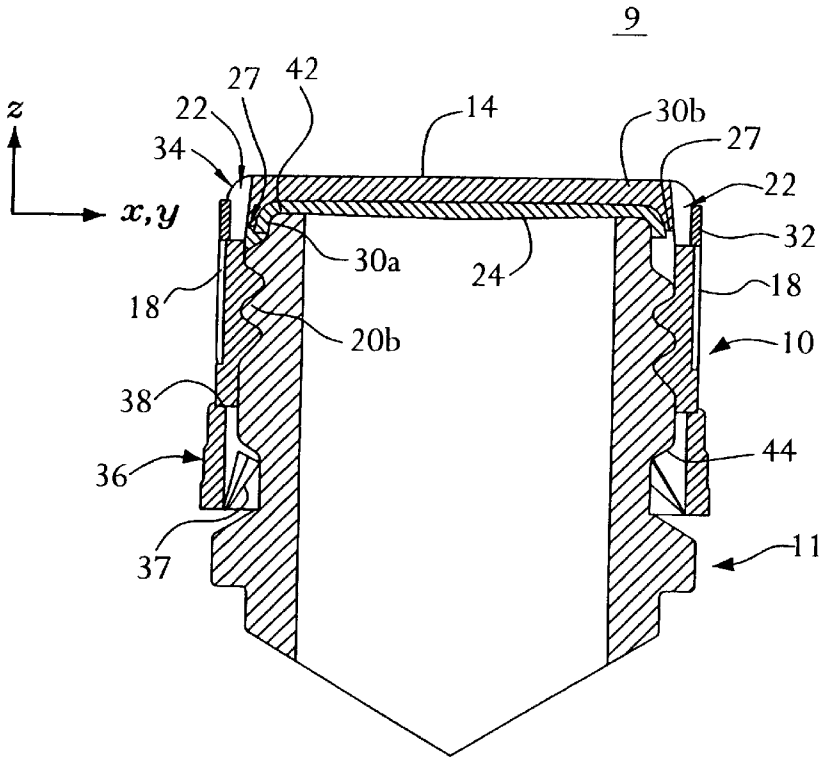
FIG. 5A is an enlarged cross sectional view of the container assembly of FIG. 1 in a fully closed position.

Referring to FIGS. 1, 5A, and 5B, container 11 has a body that smoothly narrows to form a neck 40. A thread 20*b* (or plural threads) is disposed on an outer surface of neck 40. Thread 20*b* matches thread 20*a* to enable cooperation between closure 10 and container 11. Neck 40 forms a substantially circular rim 42 at an uppermost end thereof. A circular lug 44 protrudes circumferentially around the exterior of neck 40 below thread 20*b*.

Closure 10 may include a tamper evident band 36, which is band or ring that circumferentially engages and frangibly connects to the open, lower end of lower portion 16*b* of skirt 12. The inner surface of tamper evident band 36 contains a flange 37, which when placed on the container 11, hooks under lug 44 (best shown in FIGS. 5A and 5B) of container 11. Tamper evident band 36 has sufficient resilience and elasticity so that flange 37 has a diameter slightly smaller than the diameter of lug 44, yet can be placed or formed over lug 44.

The frangible connection, designated by reference numeral 38 in FIGS. 1 and 5A, can withstand the outward deflection during application of closure 10 to the container 11, but yields under tension upon removal. Thus, when closure 10 is removed from the package, the force required to pull flange 37 over lug 74 is greater than the force required to break frangible connection 38.

FIGS. 5A and 6A illustrate the container assembly 9 in a fully closed position, in which closure 10 is fully screwed or threaded onto neck 40 such that threads 20*a* are fully engaged with threads 20*b*. Rim 42 urges against a lower side of liner compression surface 30*b* and a portion of top member inside surface 26*a* urges against an opposing side of liner compression surface 30*b* to compressibly urge liner 24 therebetween. Rim 42 and the opposing portion of top member inside surface 26*a*, as well as the portion of liner 24 therebetween, form an interface area. Thus, the closure 10 and rim 42 form an airtight top seal to isolate the contents within container 11 from the atmosphere even under conditions of high internal pressure.

The circumferentially outer portion of rim 42 preferably urges against the edge portion 30*a* of liner 24 to compressibly urge liner 24 against ridge surface 26*b* to enhance the seal between closure 10 and container 11. Preferably, the vertical face of the top of neck 40 proximate rim 42 and ridge surface 26*b* compressively urge liner edge portion 30*a* therebetween. The configuration in which liner edge portion 30*a* conforms to surfaces 26*a* and 26*b*, which form a corner that has a substantially right angle cross section (that is, planar surface 26*a* and the tangent of ridge surface 26*b* at ridge peak 28 substantially form a right angle, as shown in FIG. 3B), is termed a corner seal, which encompasses cross sectional angles other than right angles.

To maintain container package integrity and provide tamper resistance, ridge peak 28 and overhanging edge 16*d* preferably extend below (that is, are disposed lower than along the z-axis) than rim 42 while container assembly 9 is in a fully closed position, as best shown in FIG. 6A. Therefore, until the closure is removed upon use, there is not a straight-line path from vents 22 and between the closure 10 and container rim 42. Specifically, ridge portion 29 forms the corner seal to interrupt a straight line that might otherwise be formed substantially in the x-y plane through vent 22 and liner 24, thereby preventing insertion of a sharp object, such as a hypodermic needle, through vent 22 to pierce the seal by penetrating through liner 24.

Because penetrating liner 24 without marring or gouging the surrounding plastic might be overlooked by a user's casual examination, baffle 27 prevents direct access through liner 24 to prevent easily piercing the seal. With ridge portion 29 of baffle 27 blocking such direct access, an attempt to pierce the seal would likely gouge the plastic material of closure 10 and/or container 11, which would indicate tampering.

In embodiments of the closure that not employ a liner (not shown), the closure surfaces 30*a* and 30*b* directly contact rim 42. In such an embodiment, ridge portion 29 may still block or prevent straight line access to an interface area between the closure and the rim via the vent 22, thereby promoting tamper resistance in a similar manner as described above.

Referring to FIGS. 5A and 6A, liner edge portion 30*a* is exposed to the ambient atmosphere even while closure 10 is in the fully closed position. An oxygen barrier or oxygen scavenging material may be employed to prevent oxygen permeation into the interior of the container. For example, the EVA material of liner 24 or similar food grade plastic may be layered with an oxygen barrier or scavenging layer (not shown), as described in U.S. Pat. No. 5,021,515, entitled "Packaging," and U.S. Pat. No. 5,639,815, entitled, "Packaging," each of which are incorporated in their entirety. Further, the composition of liner 24 should be chosen to resist moisture penetration.

Figure 6B:
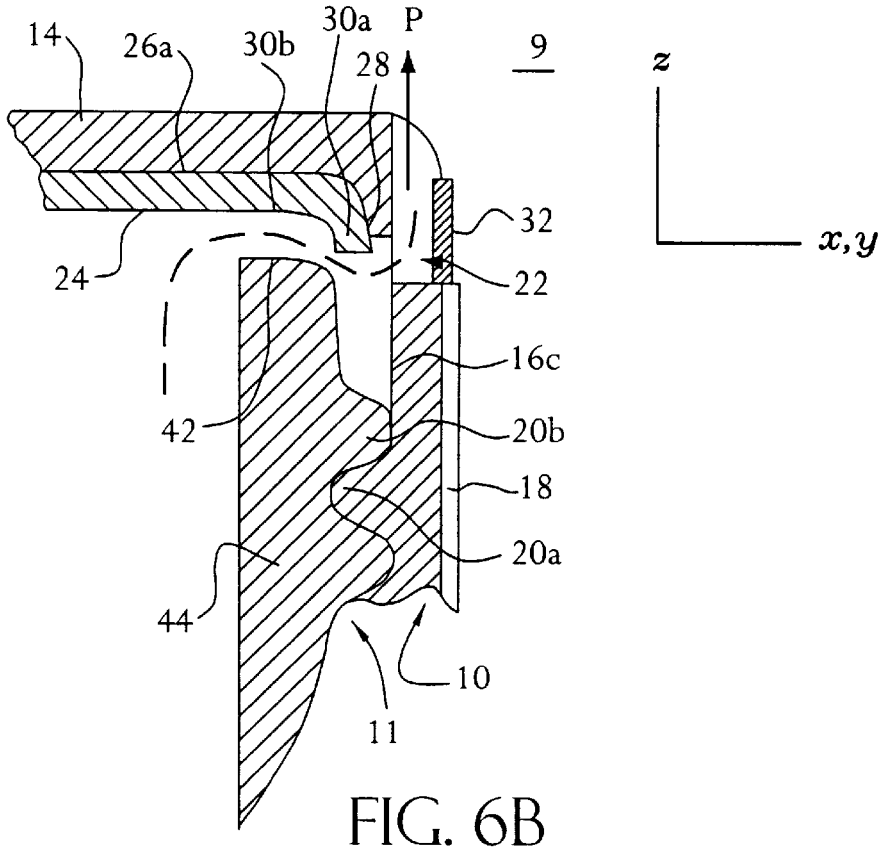
FIG. 6B is an enlarged view of a corner portion of the container assembly of FIG. 5B.

FIGS. 5B and 6B show container assembly 9 is a vented position, which may refer to any position in which at least a portion of top member surface 26*a* and/or liner 24 are spaced apart from container neck rim 42. As shown in FIG. 5B, closure 10 is sufficiently unthreaded from container 11 to rupture tamper evident band 36 at the frangible connection such that it separates from skirt 12. Thus, tamper evident band 36 remains on neck 40 of container 11 to indicate that the original seal has been broken. The phrase "vented position," as used herein and in the appended claims, refers to the relative position of the sealing portions of closure 10 (for example, surfaces 26*a*, 26*b* and/or 30*a*, 30*b*) to container 11 (for example, rim 42). Rupturing of the frangible connection is not a requirement for the container assembly to be in a vented position.

Upon a small increment of unthreading of closure 10 from container 11, edge portion 30*a* and compression surface 30*b* of liner 24 form a gap or passage with rim 42. A flowpath P, shown in FIGS. 5B and 6B, illustrates the release of gases from container 11 to the atmosphere. The gases flow from container 9 through neck 40 (on average) along the z-axis upon an initial formation of a space or passage between closure 10 and container 11. The gases flow along path P through the space provided between the upper surface of rim 42 and liner compression surface 30*b*, around the corner portion of liner 24 proximate ridge peak 28, past and between closure inner surface 16*c* and overhanging edge 16*d* (this is, the vent inlet), and into vent 22.

In the embodiment of FIG. 5A (the closure of which is shown in FIG. 4A), path P is directed vertically upward by sidewall 32 such that vent outlet 34 is oriented vertically. In the embodiment of FIG. 4B (that is, the embodiment lacking the sidewalls 32), a flow path P' is shown. Path P' is identical to flowpath P up to the point at which the gas enter vents 22. Path P' exits from vents 22 at an angle between the z-axis and the x-y plane (that is, at an oblique angle).

The flowpath P or P' enables quick dissipation of the internal pressure of the gases within container 11. Because the gases are not constrained to pass through the threads, the pressure dissipation through flowpath P of P' effectively reduces or eliminates tail end blow off, even during optimal conditions for causing blow off (for example, quickly twisting closure 10 under high temperature with the container approximately half full).

The present invention has been described with respect to a particular embodiment. However, the present invention is not limited to the particular embodiments described herein and includes numerous various that will be apparent to persons familiar with closure technology in light of the present teachings. For example, the embodiment described herein includes a liner, although the present invention encompasses a container assembly that does not employ a liner. The top surface 26*a* is described herein as substantially planar and the skirt as cylindrical, although the invention encompasses any configuration of the top surface and skirt. The closure is described as a thermoplastic, although the present invention may be employed with glass or aluminum closures, or closures of other materials. Other variations will be apparent to persons familiar with closure and container technology (and the disciplines related to closure and container technology) in light of the teachings of the above disclosure.

What is claimed is:

1. A closure for use with a container that houses pressurized products, the container having a neck including a first thread formed thereon and a rim, the closure comprising:

a top member and a circular skirt downwardly depending therefrom, the closure including a vent hole that has an inlet formed on an interior surface of the closure and an outlet formed on an exterior surface of the closure, the skirt having a second thread formed thereon that is in cooperation with the first thread to enable the closure to move between a fully closed position and a vented position, the closure and the container rim forming a seal therebetween in the fully closed position and enabling venting through the vent holes in the vented position, whereby internal pressure of the container is released through the vent holes as the closure is unthreaded from the fully closed position; the closure further including a liner disposed on an interior surface of the top member, the vent holes formed substantially outside a perimeter of the liner, the interior surface of the top member and the upper rim contacting opposing sides of the liner to seal the container in the closed position, the upper rim being spaced apart from the liner in the vented position to enable communication between the vent hole and an interior of the container in the vented position;

the top member and the skirt forming a ridge peak on the inner surfaces thereof, the ridge peak conforming an edge of the liner to space the liner apart from the vent hole.

2. The closure of claim 1 wherein the closure includes a baffle depending downwardly from top member and disposed between the container neck and the vent hole to prevent tampering.

3. The closure of claim 1 wherein the baffle had a lower edge that is disposed lower than the container rim to prevent straight line access to an interface area between the closure and the container rim via the vent.

4. The closure of claim 1 wherein the ridge peak and the top member form a ridge surface therebetween, the ridge surface and the neck proximate the rim urge against opposing sides of the liner to form a corner seal.

5. The closure of claim 1 wherein the vent hole is formed proximate an outer edge of the top member.

6. The closure of claim 5 wherein the vent hole is formed at a transition area between the top member and the skirt.

7. The closure of claim 1 wherein the closure further comprises a plurality of additional vent holes disposed in the top member.

8. The closure of claim 7 wherein each one of the vent holes are spaced equidistant apart around a perimeter of the top member.

9. The closure of claim 1 wherein the vent hole has a substantially vertical outlet.

10. The closure of claim 9 wherein the skirt includes a substantially vertical sidewall disposed on an outboard side of the vent hole.

11. The closure of claim 10 wherein the sidewall substantially encloses a vertical portion of the vent hole.

12. The closure of claim 11 wherein the sidewall entirely encloses the vertical portion of the vent hole.

13. A container assembly for pressurized products, comprising:

a container having a neck; and a closure for use with a container that houses pressurized products, the container having a neck including a first thread formed thereon and a rim, the closure comprising:

a top member and a circular skirt downwardly depending therefrom, the closure including a vent hole that has an inlet formed on an interior surface of the closure and an outlet formed on an exterior surface of the closure, the skirt having a second thread formed thereon that is in cooperation with the first thread to enable the closure to move between a fully closed position and a vented position, the closure and the container rim forming a seal therebetween in the fully closed position and enabling venting through the vent holes in the vented position, whereby internal pressure of the container is released through the vent holes as the closure is unthreaded from the fully closed position; the closure further including a liner disposed on an interior surface of the top member, the vent holes formed substantially outside a perimeter of the liner, the interior surface of the top member and the upper rim contacting opposing sides of the liner to seal the container in the closed position, the upper rim being spaced apart from the liner in the vented position to enable communication between the vent hole and an interior of the container in the vented position;

the top member and the skirt forming a ridge peak on the inner surfaces thereof, the ridge peak conforming an edge of the liner to space the liner apart from the vent hole.

14. The container assembly of claim 13 wherein the closure includes a baffle depending downwardly from top member and disposed between the container neck and the vent holes to prevent tampering.

15. The container assembly of claim 14 wherein the baffle had a lower edge that is disposed lower than the container rim to prevent straight line access to an interface area between the closure and the container rim via the vent.

* * * * *